US005172976A

United States Patent [19]

Bogdanovs

[11] Patent Number: 5,172,976

[45] Date of Patent: Dec. 22, 1992

[54] LIGHT FIXTURE LATCH AND LATCH HINGE ASSEMBLIES

[75] Inventor: Andris Bogdanovs, Liverpool, N.Y.

[73] Assignee: Cooper Industries, Inc., Houston, Tex.

[21] Appl. No.: 766,562

[22] Filed: Sep. 27, 1991

[51] Int. Cl.[5] ..... F21V 21/00

[52] U.S. Cl. ..... 362/374; 362/223

[58] Field of Search ..... 362/374, 368, 223, 224

[56] References Cited

U.S. PATENT DOCUMENTS

| | | | |
|---|---|---|---|
| 3,069,541 | 12/1962 | Thomsen et al. | 362/374 |
| 4,410,931 | 10/1983 | DeCandia et al. | 362/223 |
| 4,516,196 | 5/1985 | Blake | 362/223 |
| 4,580,200 | 4/1986 | Hess et al. | 362/374 |

FOREIGN PATENT DOCUMENTS

| | | | |
|---|---|---|---|
| 3021850 | 10/1981 | Fed. Rep. of Germany | 362/374 |
| 2638508 | 5/1990 | France | 362/374 |
| 1005556 | 9/1965 | United Kingdom | 362/374 |

*Primary Examiner*—Ira S. Lazarus
*Assistant Examiner*—Alan B. Cariaso
*Attorney, Agent, or Firm*—Laff, Whitesel Conte & Saret

[57] ABSTRACT

A latch and latch/hinge assemblies for a light fixture that removably secures a lens to opposite sides of a light fixture housing having latch captivating cavities. The lens assembly has at least one latch on one side of the lens and at least one substantially identical latch/hinge symmetrically located on the other side. The latch-/hinge includes roll pins which captivate the latch hinge in the fixture housing cavity.

40 Claims, 8 Drawing Sheets

LIGHT FIXTURE LATCH AND LATCH HINGE ASSEMBLIES

FIELD OF THE INVENTION

This invention relates to a latch, a latch/hinge assembly, a lens having the latch and/or latch/hinge assembly attached thereto and a light fixture having the lens.

BACKGROUND OF THE INVENTION

A variety of latch and hinge assemblies or mechanisms for light fixture lenses are known. These mechanisms connect the lens of the light fixture to the fixture housing and allow the lens to detach from the housing on its latched side while the lens remains attached to the housing on its hinged side. Detachment of the lens from the housing may be necessary for lamp changes and for repair work and cleaning.

One known latch and hinge assembly includes separate hinges and latches that are attached by hardware to opposite sides of the lens and housing. For example, in this assembly, the hinge mechanism is located on one side of the lens and housing. The latch mechanism is different from the hinge mechanism and is located on the lens' opposite side.

Another known assembly for securing lenses to light fixture housings includes multiple latch mechanisms. These mechanisms typically include complicated assemblies that involve attachment hardware. Because there are no hinge mechanisms in these assemblies, the entire lens must be removed from the housing for lamp changes and for repair work and cleaning.

Although the aforementioned mechanisms are provided for attaching lenses to light fixture housings, these known mechanisms have various structural limitations and therefore are ineffective in certain situations. The disadvantages of these known mechanisms are described in greater detail below.

A first disadvantage involves the use of a separate hinge and latch mechanism on a lens and housing. Because the hinge mechanism is independent of and oppositely positioned on the housing from the latch mechanism, the lens has restricted accessibility in that only the latched side of the lens may be opened. Thus, if the fixture or the latch mechanism on the fixture is obscurely located as, for example, may arise if the fixture is in a corner, then complete removal or partial opening of the lens for relamping or servicing may be awkward or difficult.

A related disadvantage is that an obscurely located fixture often necessitates the complete removal of the lens from the fixture. This undertaking is often burdensome as, for example, with separate hinge and latch assemblies, since the hinges must also be removed from the fixture to effectuate detachment of the entire lens. The removal of the hinges is generally extremely time-consuming.

Another disadvantage with the known hinge and/or latch assemblies is that these assemblies require attachment hardware for fastening them to the lenses and housings. This additional hardware has a propensity to loosen over time and requires periodic maintenance.

A further disadvantage with the known hinge and latch assemblies is that the lenses are usually not reversible on the light fixture housings.

Despite the numerous disadvantages with the above-mentioned latch and/or hinge assemblies, these assemblies are still widely used in the light fixture industry.

Thus, while these assemblies secure lenses to light fixture housings, they are not directed to any of the aforementioned problems.

Accordingly, an object of the present invention is to provide a latch and/or a latch/hinge assembly for a light fixture lens.

Another object of the present invention is to provide a latch and latch/hinge assembly for a light fixture lens that can have a latch and hinge connection on either side of the fixture housing and a latch connection on the opposite side of the housing.

Another object of the present invention is to provide a latch/hinge assembly for a light fixture lens which is attached to the lens and allows the lens to be reversibly attached on the fixture housing.

Further objects and advantages of the present invention will be readily apparent from the following description.

SUMMARY OF THE INVENTION

The present invention, in a preferred embodiment, comprises an assembly that accomplishes the foregoing objects by providing a latch and a latch/hinge assembly for a light fixture that secures a lens on a first side and an opposite second side of a light fixture housing. At least one latch/hinge assembly is located on one side of the fixture housing and at least one latch assembly on the opposite side of the fixture housing. The latch assembly detachably secures the lens to the fixture housing. The latch/hinge assembly latches and hinges the other side of the lens to the fixture housing and also, if desired, allows the latch/hinge assembly to be removed from the fixture housing. The latch assembly is preferably an over-center latch. The latch/hinge assembly is substantially the same as the latch assembly except it includes a hinge for hinging the lens or the housing. This hinge is preferably provided by a pair of roll pins connected to the latch which cooperates with a slot in a cavity in the light fixture housing. The roll pins hinge provides a means for captivating the hinge to the fixture housing.

Thus, the invention provides a latch and a latch/hinge assembly that detachably secures a lens to opposite sides of a light fixture housing. The mechanism enables the lens to be detached from one of either side of the fixture housing while remaining captive to its other opposite side. No attachment hardware, such as screws, bolts, or rivets, is required and the lens is reversible on the fixture housing.

BRIEF DESCRIPTION OF THE DRAWINGS

The inventive device will become more apparent from the following description taken in conjunction with the attached drawings illustrating the preferred embodiment wherein.

DETAILED DESCRIPTION OF THE INVENTION

Figure 1:
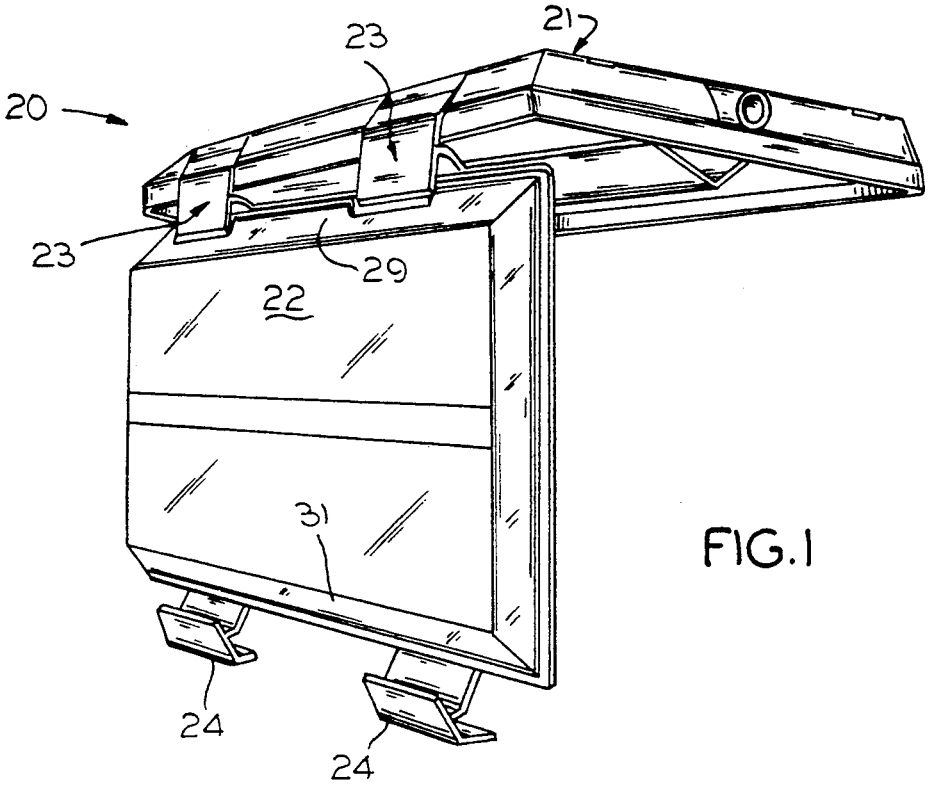
FIG. 1 is an end perspective view of a lighting fixture having one side of the lens unlatched and the other side unlatched and hinged to the fixture housing.
Figure 2:
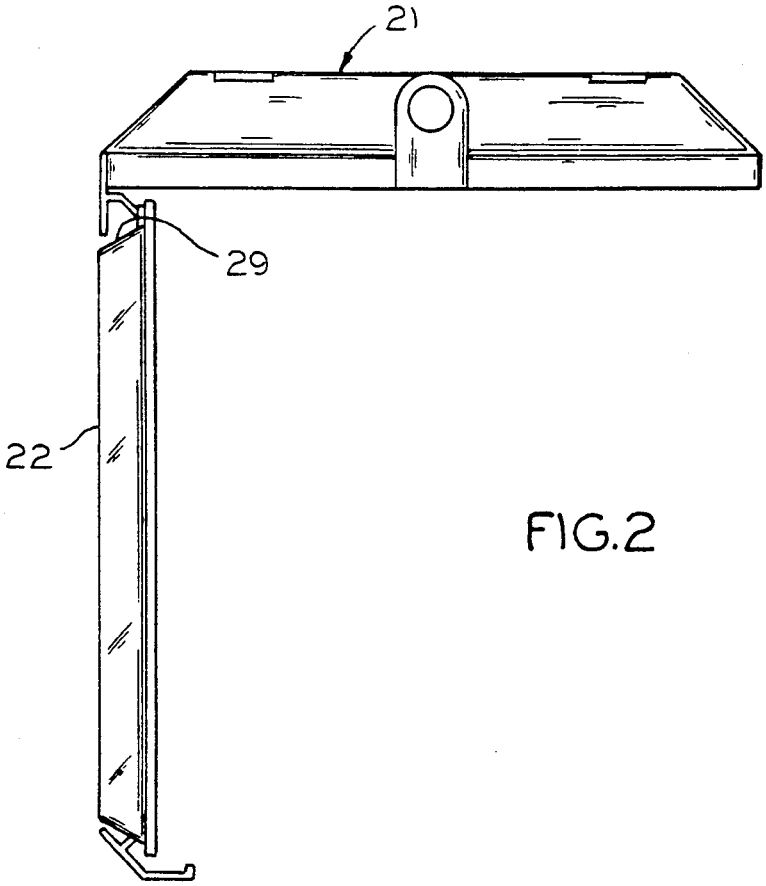
FIG. 2 is a side plan view of the light fixture of FIG. 1.
Figure 3:
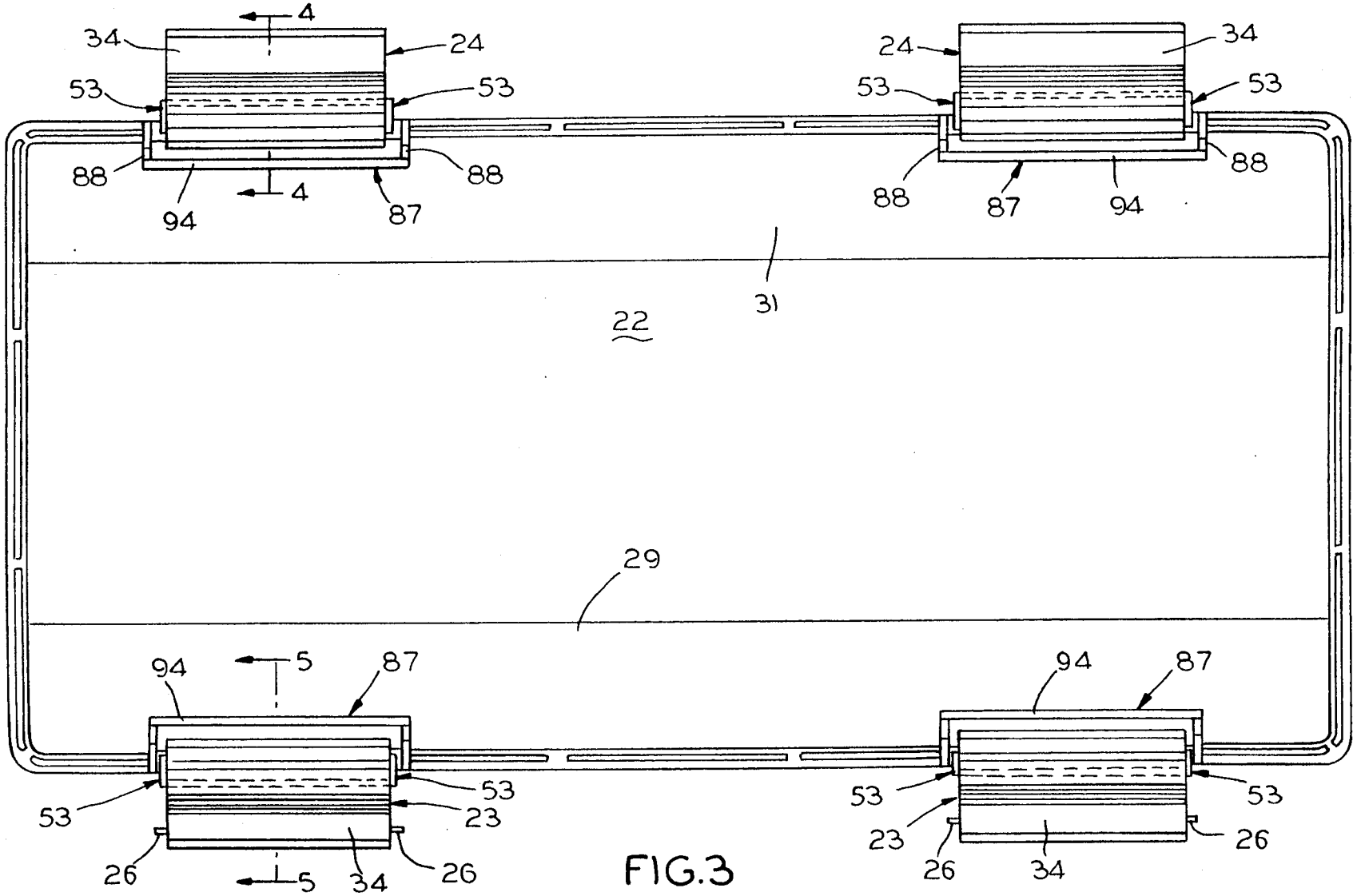
FIG. 3 is an enlarged bottom view of the lens of the present invention.

Generally referring to FIGS. 1, 2 and 3, the invention in the preferred embodiment provides light fixture 20 with a light fixture housing 21 and a light lens 22. The interior of the housing 21 has the necessary known lighting means. The interior of the lens 22 may be any appropriate configuration. A pair of latch/hinge assemblies generally denoted by the numeral 23 are on one side of the light lens 22 and a pair of latch assemblies 24 on the other side of the light lens 22. The latch 24 and latch/hinge 23 are identical except for roll pins 26 attached to latch/hinge 23. Therefore, all parts for both assemblies will have the same numbering.

Figure 5:
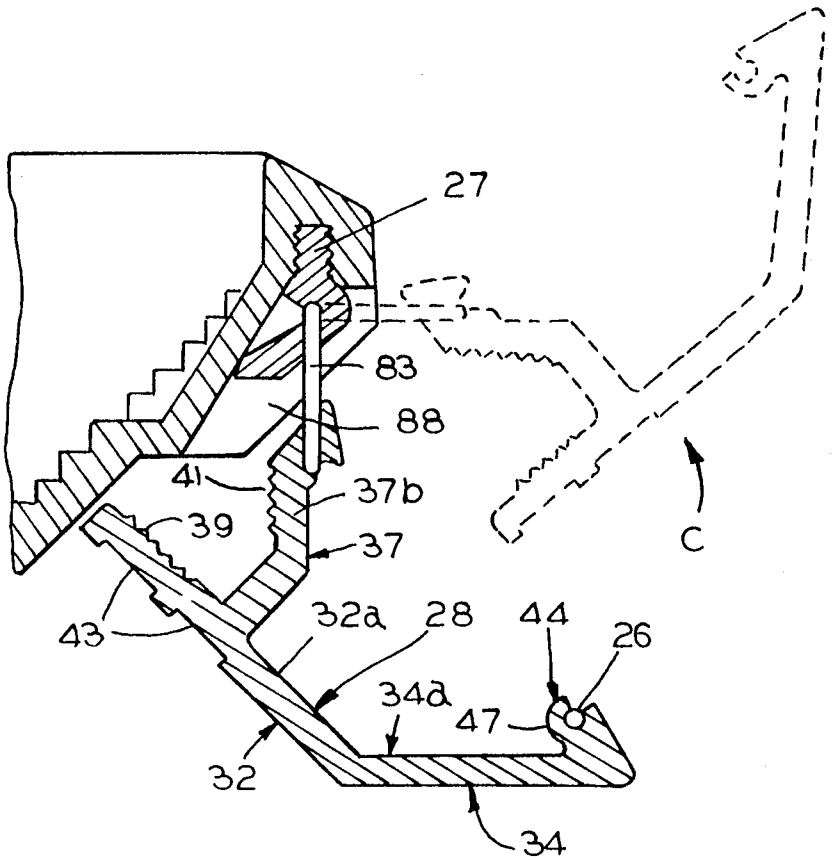
FIG. 5 is an enlarged cross-sectional view taken along lines 5—5 of FIG. 3.
Figure 4:
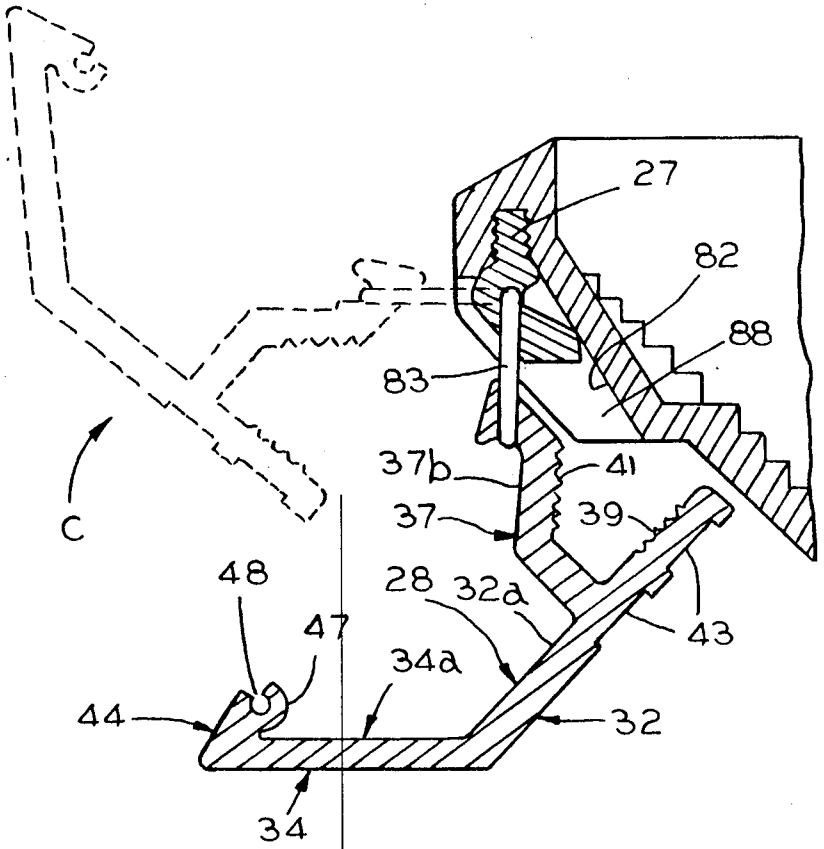
FIG. 4 is an enlarged cross-sectional view taken along lines 4—4 of FIG. 3.
Figure 14:
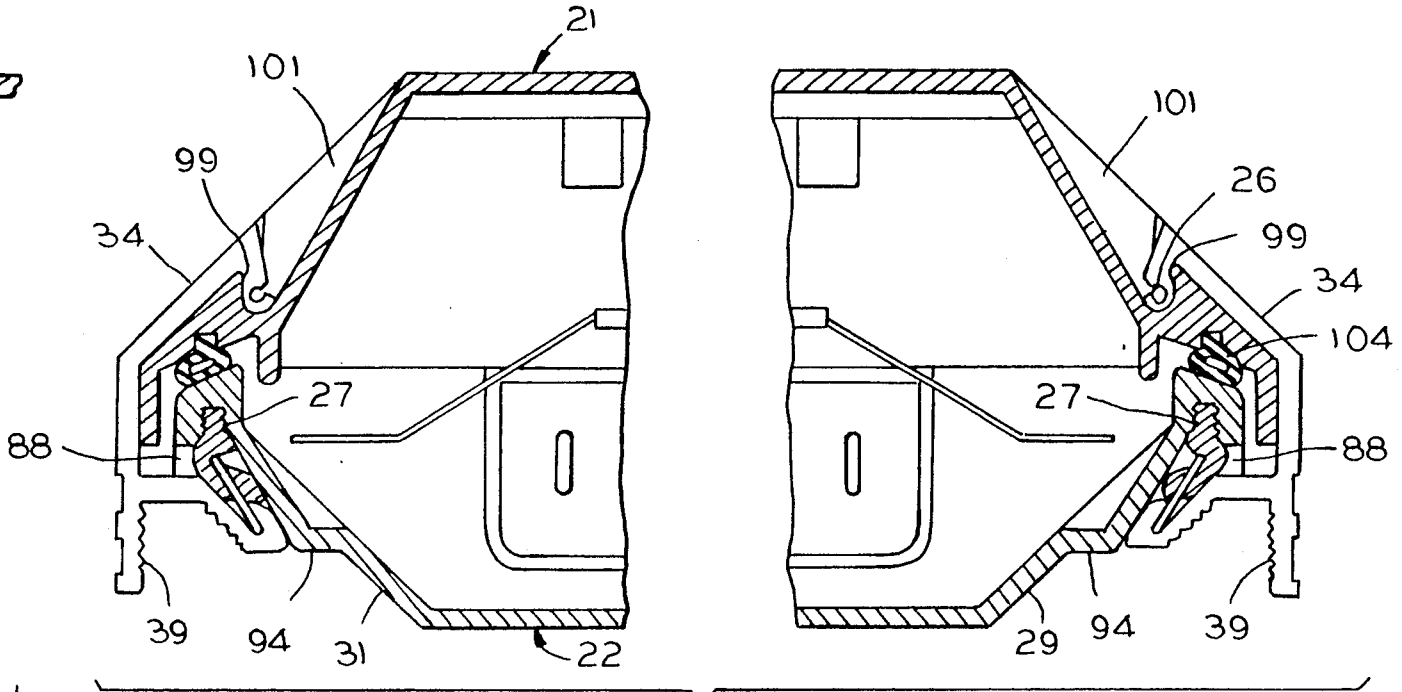
FIG. 14 is a partial cross-section view of the light fixture of the present invention in its latched position.
Figure 11:
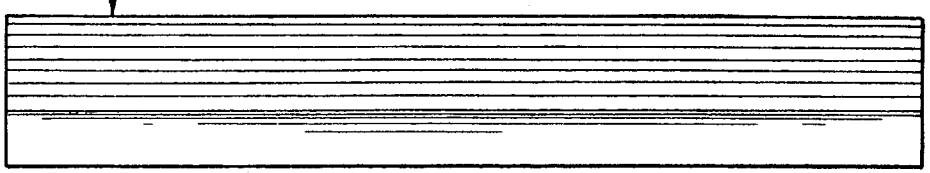
FIG. 11 is a left front view of the keeper of FIG. 10.
Figure 10:
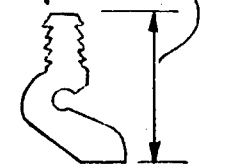
FIG. 10 is a smaller side view of the keeper shown in FIG. 9.

Referring to FIGS. 4 and 5, the latch 24 and latch-/hinge 23 have a lens keeper 27 and a housing latch connector 28. The lens connector 28 securely locks or latches the light lens 22, such as a plastic lens, to the housing 21 of the light fixture 20 (see FIG. 14).

There is at least one latch assembly 24 on a first lens side 29 and at least one latch/hinge assembly 23 on the opposite second lens side 31. The latch 24 and latch-/hinge 23 are preferably symmetrically placed on the sides 29 and 31 of the lens 22 to allow the lens to be hinged on either side of the housing. In the preferred embodiment, there are two latch assemblies 24 on first side 29 and two latch/hinge assemblies 23 symmetrically located on the second side 31. Also, in the preferred embodiment, both sides of the housing 21 include a captivating hinge mechanism which will be described in greater detail hereinafter.

Figure 6:
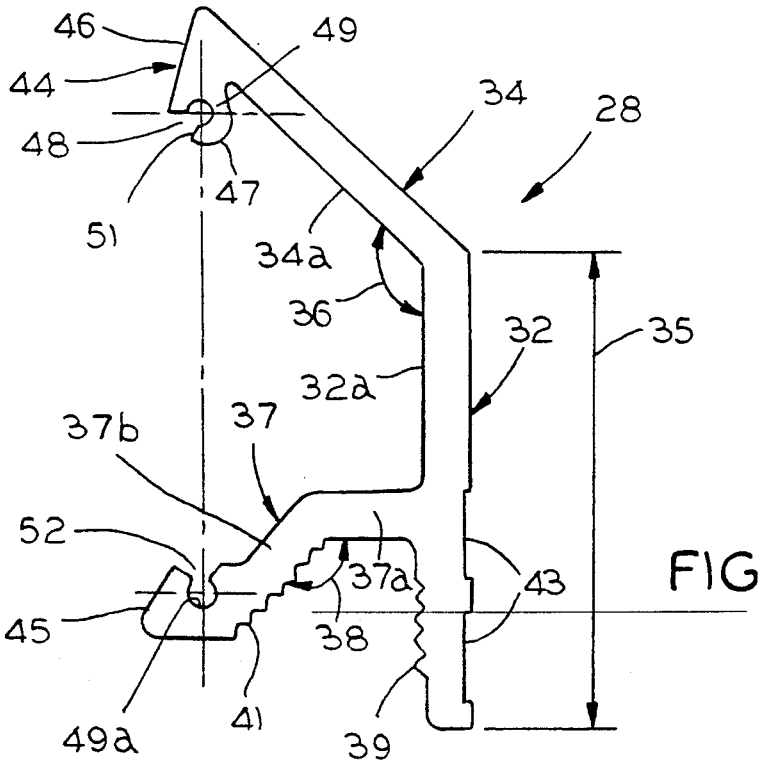
FIG. 6 is an enlarged side view of the latch section of the latch assembly of the present invention.
Figure 13:
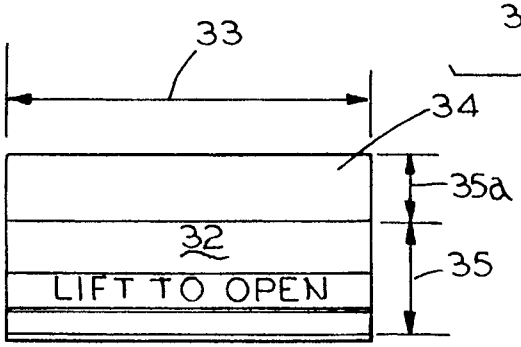
FIG. 13 is a reduced front view of the latch section of FIG. 6.

Referring first to FIG. 6, latch connector 28 is preferably a one-piece extruded aluminum latch connector. The latch connector 28 has a generally rectangular hand section 32 and a generally rectangular latch section 34. The length 33, FIG. 13 of the hand section is greater than its width 35. The latch section 34 extends from the top 26 of the hand section with the inner faces 32*a* and 34*a* forming an obtuse angle 36. The obtuse angle 36 is generally between about 120° to about 150° and is preferably about 135°. The length 33 (FIG. 13) of the latch section 34 is greater than the latch section width 35*a*. A keeper holder 37 extends inwardly from inner surface 32*a*. The keeper holder 37 has a first substantially rectangular section 37*a* extending substantially perpendicular to the inner face or wall 32*a*. A second section 37*b* extending downwardly from the first section at an obtuse angle 38 of about 130° to about 140°.

The inner surface of the hand section 32 below the keeper holder wall 37*a* includes a plurality of striations 39 which extend the length thereof. Likewise, the inner surface of the second wall 37*b* includes a plurality of striations 41 which extend along its length. The outer surface of section 32 opposite striations 39 includes a plurality of spaced rectangular sign troughs 43 that extend along its length.

The end of the latch section 34 terminates in an inwardly angled catch 44. The catch 44 as shown in FIG. 6 has a generally straight outer wall 46 terminating in an arcuate inner wall 47. The inner wall 47 is spaced from the inner wall 34*a* to form the catch area. The catch 44 has a first key-hole shaped trough 48 that extends the length thereof. The trough is formed by a first hole 49 and a diverging opening 51. Catch 44 does not have to include opening 51 nor does the hole 49 have to extend the entire length of the catch 44 but instead may be bores on each end. The hole is used to hold a pair of roll pins 26 (FIG. 3) that converts the latch 24 to a latch-/hinge 23. The opening 51 preferably opens away from wall 34*a* to provide sufficient latching surface 47.

The end 45 of keeper holder wall 37 is shaped to provide a second key-hole shaped trough 52 which extends the length of the holder 37. The trough 52 has a similar configuration as trough 48 and does not have to extend the length thereof nor is an opening required. The present invention would operate with appropriate borings on each end of the keeper holder 37 to accommodate a pair of wire bails 53.

A center line 50 passing through the center of trough openings 49 and 49*a* is generally parallel to wall 32*a*.

The purpose of the preferred key-hole shaped troughs 48 and 52 is to permit a substantially finished product to be produced by extrusion. The troughs permit this whereas holes and bores would require additional finishing steps such as drilling holes.

Figure 8:
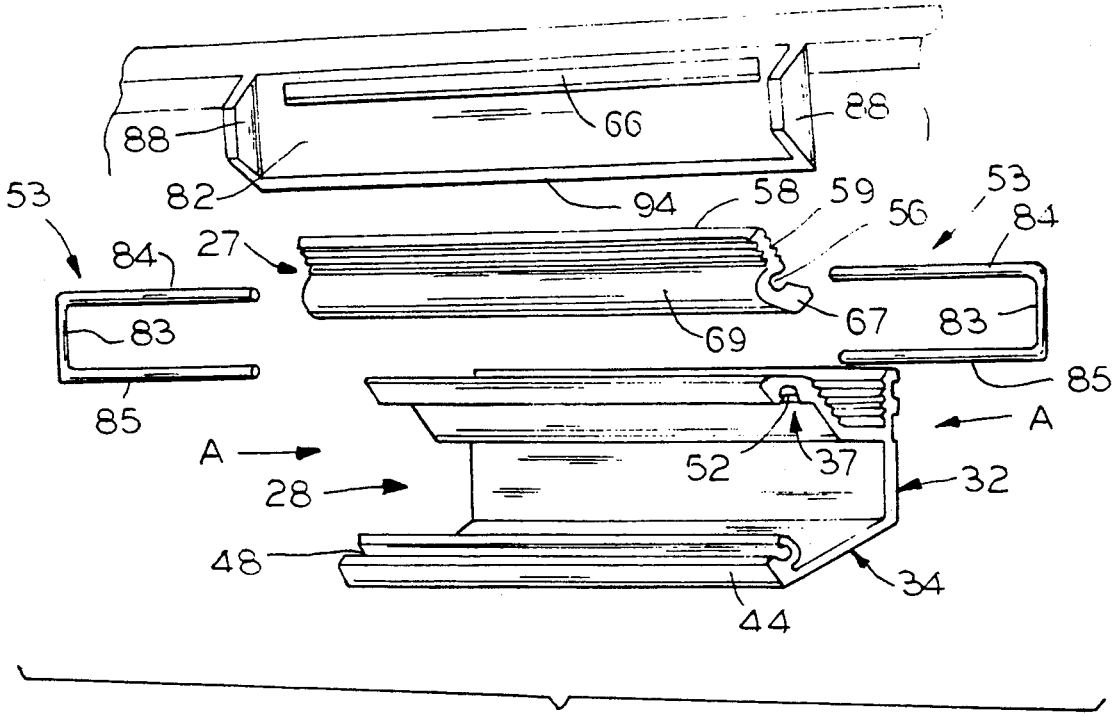
FIG. 8 is a partial perspective view of the lens and separate parts of the latch assembly of the present invention.
Figure 9:
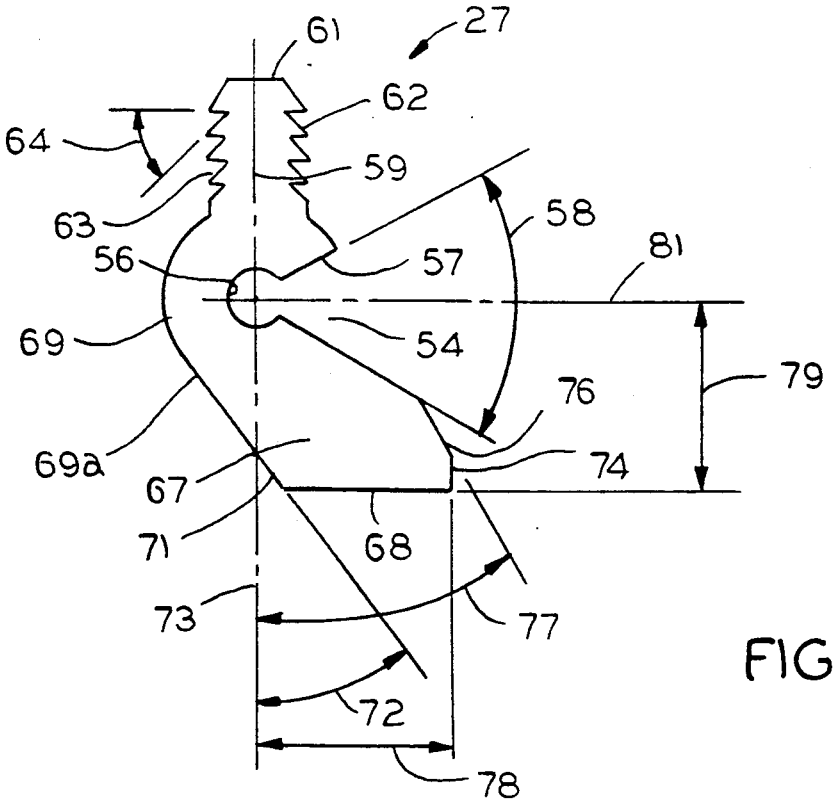
FIG. 9 is an enlarged side view of the keeper of the present invention.

Referring to FIGS. 8–11, keeper 27 is preferably extruded aluminum. The keeper 27 is generally kidney-shaped and has a central portion 69, a lens attaching portion 59 and a lens support portion 67. A third key-hole shaped trough 54 is formed in the central portion 69 approximately in the center of the keeper and extending the length thereof. The trough 54 has a cylindrical portion 56 and a diverging opening 57 which in the preferred embodiment diverges to form an angle 58 of about 50° to about 70° and as shown in FIG. 9, about 60°. The opening 57 opens in the inner surface of the keeper. The keeper lens attaching portion 59 is substantially rectangular with a flat end 61. The lens attaching portion has a plurality of longitudinal and reverse oriented sharp striations 62 and 63 on its inner and outer surfaces.

These striations 62 and 63 have sharp tips and a downward angle 64 (shown only on one side) of about 30° to about 40°. This structure allows one-way entry of the keeper into a lens keeper cavity 66. Thus, keeper 27 is permanently secured to lens 22 by its insertion into the keeper cavity 66 FIG. 4 and 5.

The keeper arcuate central portion includes an outer arcuate surface 69*a* that curves from the end 59 to the other end 67. The keeper lens support end 67 terminated with a flat surface 68 and has a generally straight wall 71 connecting the arcuate surface 69*a* with the flat end surface 68. The straight wall 71 forms an acute angle 72 with the center line 73 that passes through the center of the cylindrical trough 56 and through the center of end 59. The angle 72 is preferably about 35° to about 45° and is shown as about 40°.

A vertical surface 74 extends upwardly from the end 68 or the inner side of the keeper 27. A sloped wall 76 extends inwardly from the vertical wall to the lower surface of the diverging opening 57. The angle 77 formed by the center line 73 and the wall 76 is preferably about 25° to about 35° and is shown as about 30°. The distance 78 between the center line 73 and the vertical surface 74 is approximately equal ±0.05 inches to the distance 79 between the end 68 and the center line 81 which is 90° to the center line 73.

The keeper flat inner surface 76 is adapted to contact the lens surface 82 when the keeper 27 is permanently attached to the lens.

Two wire bails 53, FIG. 8, shaped like wickets each including a base 83 and first leg 84 and second leg 85. First leg 84 is parallel to second leg 85. Legs 85 are sized to freely extend into second keyhole 52 in the catch and into a third keyhole 54 in keeper 27.

The length of keeper 27 is substantially equal in length to the length of the latch connector 28. The width 86 of keeper 27 is approximately 20 to 30% the width of the latch connector 28. When the latch is locked or latched, FIG. 9, preferably the center line 73 of keeper 27 FIG. 9 is generally parallel to inner surface 32*a*, FIG. 6.

Figure 15:
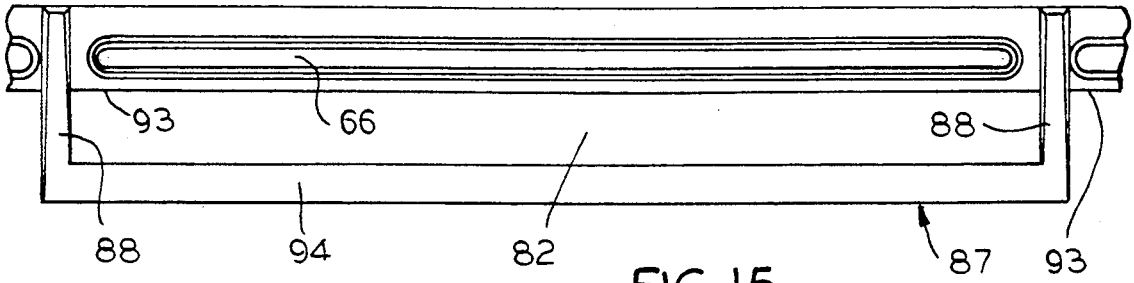
FIG. 15 is an enlarge view of a portion of the lens of FIG. 3.
Figure 16:
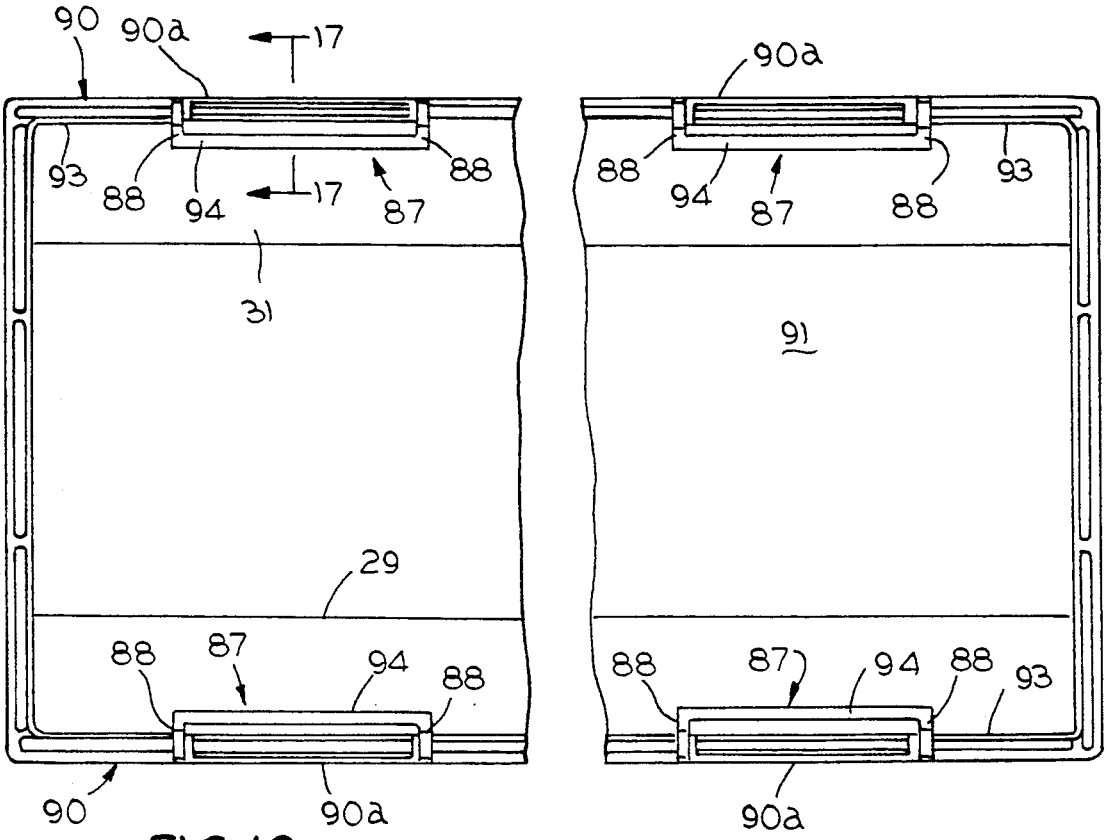
FIG. 16 is a bottom plan view of a lens.
Figure 17:
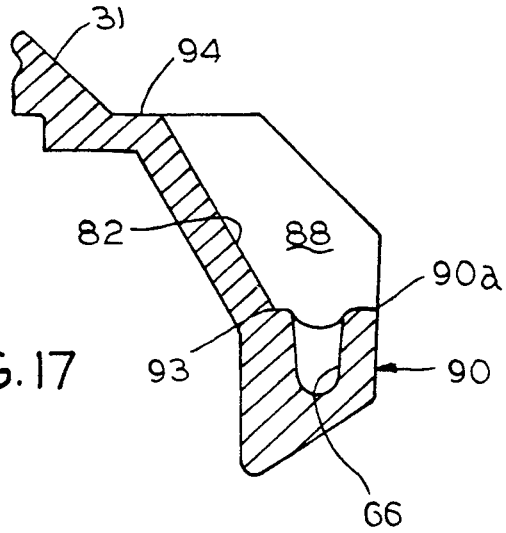
FIG. 17 is an enlarged cross-sectional view taken along lines 17—17 of FIG. 16.

As shown in FIGS. 15–17, the plastic lens 22 interior is not shown in detail. The outer surface has a shoulder periphery 90, an outer generally flat central surface 91 extending approximately the length thereof and two sides 92 sloping from the center 91 to the inner portion 93 of the lens shoulder 90. Latch holders 87 are located adjacent a periphery of lens 22 and are integrally formed therewith. There is at least one latch holder 87 on each side of the lens. In the preferred embodiment, there are four separate but identical latch holders 87 positioned symmetrically on the lens 22, two on each of the first and second sides 29 and 31 respectively, FIG. 14. Each latch holder 87 includes a keeper cavity 66 into which the striated end 59 of keeper 27 fits.

Latch holder 87 also includes a pair of spaced parallel elevated latch holder side walls 88. The side walls 88 extend upwardly from the outer periphery 90*a* of the lens shoulder 90 and from the lens side walls 29 and 31. The spaced holder side walls 88 are used to maintain bail wires 53 in the keeper and latch connector. Between the walls 88 is a flat bottom wall 82 of the latch holder. The flat bottom wall 82 has a width greater than the keeper width 78 and inclines from the inner portion 93 of the lens shoulder 90 to a latch holder shoulder 94. The latch holder shoulder 94 joins the lens side wall 29, 31 and the flat bottom wall 82. As shown, the latch holders 57 preferably only extend the width of the lens side walls 29, 31.

Preferably, the height of the walls 88 adjacent the keeper key-hole 54 is at least two wire bail diameters above the keeper key-hole when the keeper is mounted in the lens cavity. The distance between the walls 88 is greater than the length of the keeper preferably by at least three bail wire diameters. The length is sufficiently short to limit the outward movement of the two wire bails 53 so that they cannot be removed from the keeper.

FIG. 8 illustrates the method of assembling the latch and/or latch hinge. Initially, bail wire legs 84 and 85 of each of bails 53 are inserted into both ends of the cylindrical opening of the keeper key-hole 56 and connector key-hole 52 in the direction indicated by arrows A. The keeper 27 and the distance between the two bail legs are dimensioned so that the latch is an over-center latch. The preferred dimensions of the keeper and bail wires permit the attached keeper to rotate 360° about the bail wire before the keeper is attached to the lens. Also, the keeper is attached to latch connector 28 so that when keeper end 68 faces the keeper holder, keeper wall 74 faces inner surface 32*a*.

Subsequent to the insertion of the bails 53 into openings 52 and 56, the connected keeper 27 is positioned on the lens so that the keeper end 61 abuts against the opening of the keeper cavity 66. The inner surface 76 is substantially flush with or in contact with the lens wall 82. The bails are held captive by the walls 88. The latch connector 28 is pivoted out of the way to leave surface 68 free from obstruction.

The striated end 59 of the keeper 27 is seated into cavity 66. Sufficient force is applied to the surface 68 to drive the striated end 59 into the cavity 66. The cavity 66 is dimensioned slightly less than dimensions of the keeper end 59 to permit a pressure fit.

The reverse striations 62 and 63 allow one-way forward entry of the keeper into the lens cavity 66, but prevent backward movement of the keeper out of the cavity. After the insertion of keeper into cavity 66, elevated sides 88 function to prevent the outward movement of the bails and substantially permanently attaches the latch connector 28 to the lens 22.

FIGS. 3 and 4 show the appearance of the latch 24 and latch/hinge 23 subsequent to its insertion into keeper cavity 66. While elevated sides 88 prohibit outward movements of bails 53, they do allow pivotal movement. Thus, the latch connector 28 may freely rotate outwardly and upwardly in the direction indicated by arrow C. The rotational movement permits the latching effect of latch 24.

As shown in FIGS. 7, 12, 14 and 18, latch connector 28 and lens 22 are attached to housing 21 of fixture 20 by engaging catch 44 in a latch cavity 96 formed in the exterior of housing 21.

Housing latch receiver cavities 96 are equal to the number of latch holders formed on the lens . The outer surface of the light fixture housing 21 has a pair of converging first and second sides 100. At least one latch receiver cavity 96 is formed in one housing side, and at least one latch receiver cavity 96 is formed in the other second housing side. The number of latch receiver cavities is usually identical to the number of latches on said lens. Each of the cavities include an angled first and second back portion 97 and 98, respectively. First and second back portions 97, 98 are separated by a ledge 99. Spaced and parallel wedge shaped sides 101 outline and form the side boundaries of cavity 96. Ledge 99 has an under surface 102 with an arcuate end that is dimensioned to accommodate catch 44.

Figure 18:
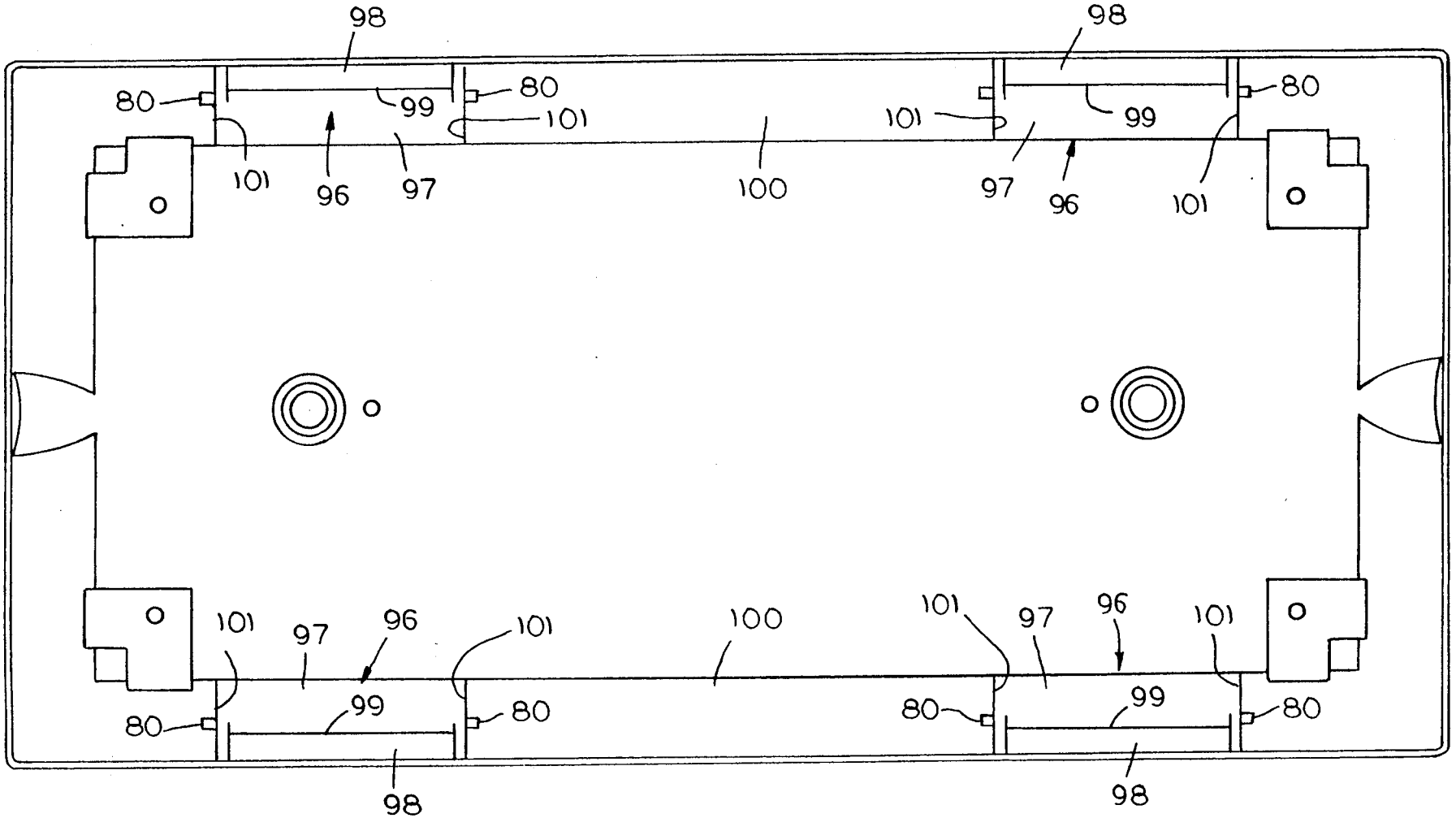
FIG. 18 is a top view of the fixture housing without any latch or latch/hinge assemblies thereon.

A slot or vertically extending roll pin groove 80 is located in each of sides 101. The grooves 80 extend upwardly from the bottom of the ledge 99 to the top of side wall 101. The slots are sized and adapted to receive roll pins 26. The roll pins 26 extend from each end of catch 44 as previously described. Each of the four cavities 96, as shown in FIG. 18, have identical configurations to the cavity illustrated in FIG. 7 and 12. The slots 80 are such that they permit the catch 44 of latch/hinge 24 to be captivated such that the latch/hinge remains pivotally mounted to the housing 21 when unlatched, as shown in FIGS. 1 and 2.

Figure 7:
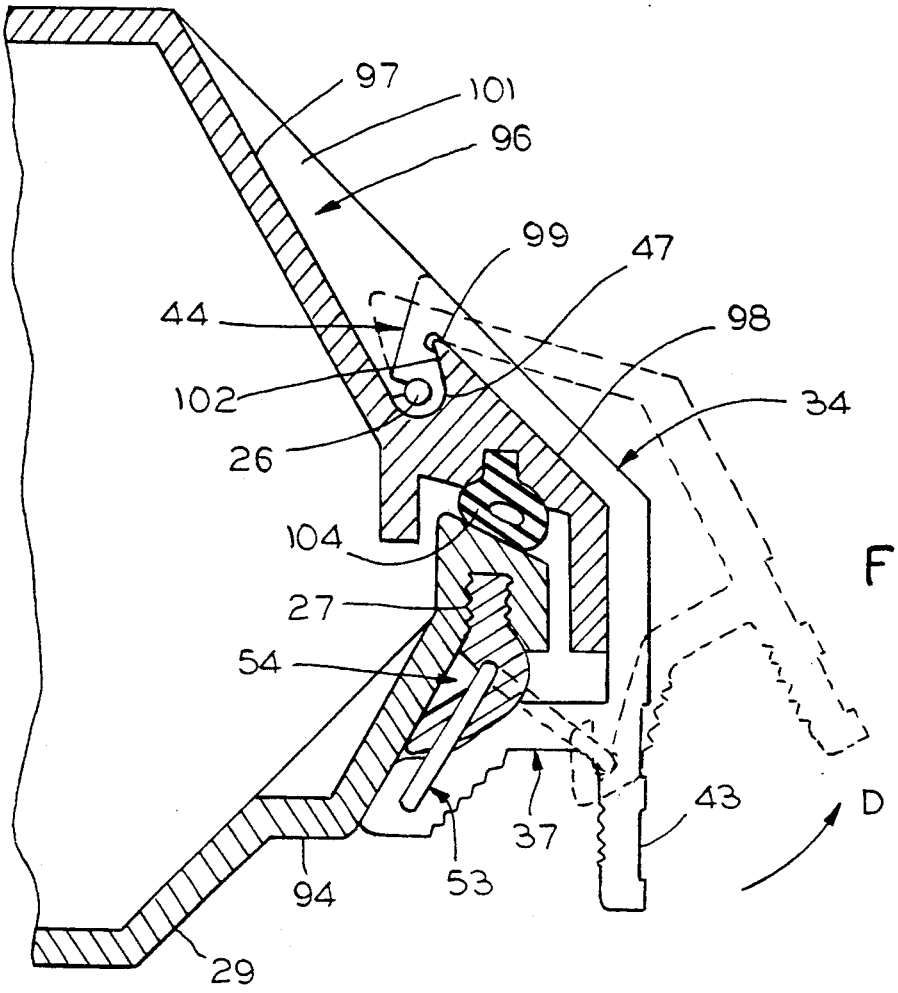
FIG. 7 is an enlarged partial cross-sectional view light fixture of the present invention showing the latch-/hinge assembly in its latched position.

Referring to FIG. 7, latch/hinge and latch assemblies 23, 24 are latched to housing 21 by initially rotating latch connector 28 outwardly and upwardly, as shown by the arrow C in FIGS. 4 and 5. Rotation of latch connector 28 should continue until catch 44 of connector 28 is adjacent to, behind and in contact with the under surface 102 of ledge 99.

The basic latching mechanism is of an over-center compression design. Referring to FIG. 7, which illustrates a latch/hinge assembly, latch connector 28 is latched on the housing 21 in its over-center locked position. This locked over-center positioning of latching connector 28 causes the bail ends 83 in the preferred embodiment to be rotated past the vertical axis 73 of the keeper by approximately 1° to about 35° and preferably approximately 30 degrees past the vertical axis 73. When latching connector 28 is rotated on bails 53, either towards or away from cavity 96, keeper holder 37 travels in an arc formed by the bails. The above described latching procedure is used on each of the four assemblies 23 and 24.

To unlatch an assembly, the user manually pulls on surface 39 (FIG. 7) so that latch connector 28 moves upwardly and outwardly, as indicated by the arrow D. In the case of latch 24, this movement causes catch 44 to disengage from ledge 99 of housing cavity 96, and latching connector 28 to rotate downwardly and swing freely from lens 22 (FIGS. 1, 2). In the case of latch/hinge 23, this movement does not cause catch to disengage from the ledge, but roll pins 26 in slots 80 captivate the catch so that it remains connected to the housing 21.

Figure 12:
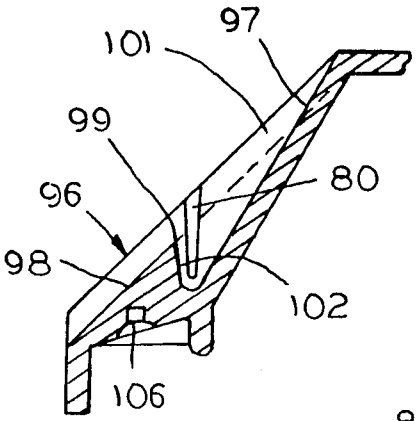
FIG. 12 is a partial cross-sectional view of the light fixture housing.

In all of the embodiments, a seal 104 (see FIG. 7 and 14) is located between lens 22 and housing 21 around the inner perimeter of the housing so that the fit between the component parts of the fixture is tight. The seal is attached to a seal cavity 106 formed in the housing (FIG. 12).

FIG. 1 shows the appearance of light fixture 20 when both latch/hinge and latch assemblies 23 and 24 are unlatched and latch 24 is disengaged from one side of the fixture housing. As shown, the side of the lens 22 with the latch/hinge assembly 23 is hinged on the housing 21 while the opposite side of the lens is unlatched, thus allowing lens 22 to freely swing on its one side.

Lens 22 may be completely removed from housing 21 by initially unlocking all the assemblies, disengaging the latches 24 on one side, as shown in FIGS. 1 and 2, and then additionally lifting the hinged latch connector 28 of latch/hinges 23 on the opposite side until the roll pins 26 on the catches 44 disengage from the slots 80 of the latch locking cavities.

All latch cavities 96 in housing 21 are identical so the latch/hinges 24 may be placed on either side of the housing 21.

Therefore, it should be recognized that, while the invention has been described in relation to a preferred embodiment thereof, those skilled in the art may develop a wide variation of structural details without departing from the principles of the invention. Accordingly, the appended claims are to be construed to cover all equivalents falling within the true scope and spirit of the invention.

I claim:

1. A light fixture having a lens and a light fixture housing comprising said lens having an outer first lens side, an outer second lens side, at least one latch assembly attached to said first lens side adjacent a periphery of said first lens side, at least one latch/hinge assembly attached to said second lens side adjacent periphery of said lens second side, each of said latch and latch/hinge assemblies having a latch connector hand section, said hand section having a length greater than a width, said hand section having an inner face and an outer face;

a latch section having a first portion extending from said hand section and a catch formed on the end of said first portion, a keeper holder section extending from the inner face of said hand section, a keeper that is securely attached to said lens by insertion into a keeper cavity, and said keeper pivotally attached to said keeper holder section of said latch connector hand section, said latch/hinge assembly being symmetrical with said latch assembly and there being the same number of latch/hinge assemblies as latch assemblies, and said latch/hinge assembly being substantially the same as said latch assembly with said latch/hinge assembly additionally having hinge means, said light fixture housing having, a first housing side and a second housing side, at least one first latch receiver on said first housing side, at least one second latch receiver on said second housing side, said first and second latch receivers being identical and symmetrical, and wherein there are the same number of latch receivers on each of said first and second housing sides, and each of said first and second latch receivers having a catch receiver and each of said latch receivers having means to removably captivate said latch/hinge means.

2. The light fixture of claim I wherein said at least one first latch receiver is a cavity formed in said first housing side, said at least one second latch receiver is a cavity formed in said second housing side, each of said first and second latch receiver cavities having a pair of spaced wedged shaped side walls and a base extending between said wedged shaped side walls, a latch catch receiver having a portion thereof spaced above said base, said latch catch receiver having an arcuate under surface, said latch catch receiver having a length less than the length of said spaced walls of said first and second housing sides, and a vertically extending roll pin captivating groove formed in each said wedged shaped side walls.

3. The light fixture of claim 1 wherein the outer surface of the lens has a shoulder periphery, said first lens side and said second lens side converge from an inner portion of said lens shoulder to a lens central portion, each of said first and second latch holders having a pair of spaced substantially parallel latch holder side walls extending upwardly from said lens sides and extending from an outer portion of the lens shoulder periphery to a portion of the lens side wall width, keeper cavities formed in the shoulder periphery of said lens between said latch holder side walls, and a latch assembly keeper and a latch/hinge assembly keeper being retained in said respective keeper cavities said lens being a one-piece plastic molded lens, said first and second latch holders being integrally formed on the first and second sides of the lens adjacent the periphery of said lens, said first and second latch holders each having a central flat surface inclining from said inner portion of said lens shoulder to said portion of the lens side wall width and a latch holder shoulder joining said latch side walls and said central flat surface.

4. The light fixture of claim 3 wherein said at least one first latch receiver is a cavity formed in said first housing side, said at least one second latch receiver is a cavity formed in said second housing side, each of said first and second latch receiver cavities having a pair of spaced wedged shaped side walls and a base extending between said wedged shaped side walls, a latch catch receiver having a portion thereof spaced above said base, said latch catch receiver having an arcuate under surface, said latch catch receiver having a length less than the length of said spaced walls of said first and second housing sides, and a vertically extending roll pin captivating groove formed in each said wedged shaped side walls.

5. The light fixture of claim 1 wherein the inner face of said hand section and the inner face of said latch section form an obtuse angle, said catch having a catch arcuate end, an end of said keeper section providing a keeper holder, a line passing through the arcuate catch end and the keeper holder being substantially parallel with the inner face of said hand section, said latch connector is one-piece, said keeper being one-piece, said keeper having a width less than the width of said hand section and a length substantially equal to the length of said hand section, said keeper having a central keeper portion, a lens attaching portion extending from one end of the central keeper portion and a lens support portion extending from the other end of said central keeper, said keeper lens attaching end having a plurality of reverse striations on its inner and outer faces, said keeper lens attaching portion inserted in said keeper cavity to secure the keeper to the lens, a third key-hole trough formed in said keeper central portion, and a pair of bail wires extending into said third key-hole and said second hole pivotally attaching said keeper to said latch keeper holder, said bail wires and keeper being sized to provide an over center latch.

6. A light fixture comprising a one-piece plastic molded lens having on its outer surface; a shoulder periphery, a first side and an opposite second side, said first and second sides converging from an inner portion of said lens shoulder to a lens central portion, at least one first integrally formed latch holder on the first side of the lens adjacent the periphery of said lens, each of said first and second latch holders having a pair of spaced substantially parallel latch holder side walls extending upwardly from said lens first side and extending from an outer portion of the lens shoulder periphery to a portion of the lens side wall width, a lens keeper cavity formed in the shoulder periphery of said lens between said latch holder side walls, a central flat surface inclining from said inner portion of said lens shoulder to said portion of the lens side wall width, a latch holder shoulder joining said latch side walls and said central flat surface;

a latch assembly attached to each of said lens latch holders on said lens side and a latch/hinge assembly attached to each of said lens latch holders on said lens second side, each of said latch and latch/hinge assemblies having a latch connector with a) a substantially rectangular hand section, said hand section having a length greater than a width, said hand section having an inner face and an outer face, b) a generally rectangular latch section, said latch section having a first substantially rectangular portion extending from said hand section and forming an obtuse angle between the inner face of said hand section and the inner face of said latch section and a catch formed on the end of first portion, said catch having a catch arcuate end, said catch extending downward and spaced from the inner face of said latch section;

c) a keeper holder section, said keeper holder section extending from the inner face of the said hand section, said keeper holder section having a length substantially equal to the length of said hand section, said keeper holder section having a first keeper holder section extending substantially perpendicular to the inner face of said hand section and a second keeper holder section extending at an obtuse angle from said first keeper holder section away from said catch, a second key-hole trough formed in the end of said second keeper. holder section with a funnel opening facing said catch;

a center line passing through the center of a first key-hole and said second key-hole being substantially parallel with the inner face of said hand section, a one-piece keeper that is securely attached to said lens by insertion into said lens keeper cavity, said keeper having a width less than the width of said hand section and a length substantially equal to the width of said hand section, said keeper having a central keeper portion, a lens attaching portion extending from one end of the central keeper portion and a lens support portion extending from the other end of said central keeper, said keeper lens attaching end inserted in and attached to said lens keeper cavity, a pair of bail wires for extending into said keeper central portion and said latch holder section to pivotally attach said keeper to said latch keeper holder section of said latch connector, said bail wires and keeper being sized to provide an over center latch, said latch/hinge assemblies having roll pins extending from each end of said latch connector catch, a light fixture housing having on its outer surface, a first housing side and a second housing side, at least one first latch receiver cavity formed in said first housing side, at least one second latch receiver formed in said second housing side, each of said first and second latch receiver cavities having a pair of wedged shaped spaced side walls extending the width of housing first side and a base extending between said wedged shaped side walls, a latch catch receiver inclining from said base and having an arcuate surface to receive said latch catch, said latch catch receiver having a length less than the distance between said spaced walls, a vertically extending roll pin captivating groove formed in each said wedged shaped side walls to receive said latch/hinge roll pins, and said first and second latch receiver cavities being identical and symmetrical and there being the same number of latch receiver cavities as there are lens latch holders.

7. A latch assembly for a light fixture comprising: a latch connector having a) a hand section, said hand section having a length greater than a width, said hand section having an inner face and an outer face, b) a latch section, said latch section having a first portion extending from said hand section and a catch formed on the end of said first portion, and c) a keeper holder section extending from the inner face of said hand section, a keeper, said keeper having a lens attaching portion for securely attaching said keeper to a light lens by insertion into a light lens cavity, and means to pivotally attached said keeper to said latch keeper holder section of said latch connector.

8. The latch assembly of claim 7 wherein the inner face of said hand section and the inner face of said latch section form an obtuse angle, said catch having a catch arcuate end, an end of said keeper section providing a keeper holder, a line passing through the arcuate catch end and the keeper holder being substantially parallel with the inner face of said hand section.

9. The latch assembly of claim 7 wherein said keeper has a central keeper portion, a lens attaching portion extending from one end of the central keeper portion and a lens support portion extending from the other end of said central keeper portion, said keeper lens attaching end having means for securing the keeper to a light lens have a corresponding keeper attaching means, pivot holder means formed in said keeper central portion, and pivot means to pivotally attach said keeper pivot holder means to said latch keeper holder section.

10. The latch assembly of claim 8 wherein said keeper has a central keeper portion, a lens attaching portion extending from one end of the central keeper portion and a lens support portion extending from the other end of said central keeper portion, said keeper lens attaching end having means for securing the keeper to a light lens having a corresponding keeper attaching means, pivot holder means formed in said keeper central portion, and pivot means to pivotally attach said keeper pivot holder means to said latch keeper holder section.

11. The latch assembly of claim 8 wherein said latch connector is one-piece, pin holding means formed in said catch arcuate end, said keeper being one-piece and having a width less than the width of said hand section and a length substantially equal to the length of said hand section, said keeper having a central keeper portion, a lens attaching portion extending from one end of the central keeper portion and a lens support portion extending from the other end of said central keeper, means formed in said keeper central portion to hold a pivot means and pivot means to pivotally attach said keeper central portion to said latch keeper holder, said pivot means and keeper sized to provide an over center latch when said keeper is attached to a lens.

12. A latch assembly for a light fixture comprising: a one-piece extruded aluminum latch connector having a) a substantially rectangular hand section, said hand section having a length greater than a width, said hand section having an inner face and an outer face, a portion of said inner face having a plurality of striations extending the length thereof, and said outer surface having at least one rectangular sign trough formed therein;

b) a generally rectangular latch section, said latch section having a first substantially rectangular portion extending from said hand section and forming an obtuse angle between the inner face of said hand section and the inner face of said latch section and a catch formed on the end of first portion, said catch having an arcuate end, said catch extending downward and spaced from the inner face of said latch section, a trough formed in said catch arcuate end and extending the length thereof, said trough having a cylindrical inner portion and a funnel opening facing away from said latch section inner surface; and c) a keeper holder section, said keeper holder section extending from the inner face of the said hand section, said keeper holder section having a length substantially equal to the length of said hand section, said keeper holder section having a first keeper holder section extending substantially perpendicular to the inner face of said hand section and a second keeper holder section extending at an obtuse angle from said first keeper holder section away from said catch, a second key-hole trough formed in the end of said second keeper holder section with a funnel opening facing said catch, a center line passing through the center of said first key-hole and said second key-hole being substantially parallel with the inner face of said hand section, a one-piece keeper, said keeper having a width less than the width of said hand section and a length substantially equal to the width of said hand section, said keeper having a central keeper portion, a lens attaching portion extending from one end of the central keeper portion and a lens support portion extending from the other end of said central keeper, said keeper lens attaching end having a plurality of reverse striations on its inner and outer faces to provide means for attachably securing the keeper to a light lens by insertion into a corresponding keeper slot, a third key-hole trough formed in said keeper central portion, and a pair of bail wires for extending into said third key-hole and said second hole to pivotally attach said keeper to said latch keeper holder, said ball wires being sized to provide an over center latch.

13. The latch assembly of claim 7 comprising a pivot pin extending from each end of said catch to provide a latch/hinge assembly.

14. The latch assembly of claim 8 comprising a pivot pin extending from each end of said catch to provide a latch/hinge assembly.

15. The latch assembly of claim 9 comprising a pivot pin extending from each end of said catch to provide a latch/hinge assembly.

16. The latch assembly of claim 10 comprising a pivot pin extending from each end of said catch to provide a latch/hinge assembly.

17. The latch assembly of claim 11 comprising a pivot pin extending from each end of said catch arcuate ends to provide a latch/hinge assembly.

18. The latch assembly of claim 12 comprising a roll pin extending from each end of said catch key-hole trough, and said pins being attached to said catch key-hole trough by press fitting said pins into said catch key-hole trough to provide a latch/hinge assembly.

19. A light fixture housing having an outer surface comprising:

a first housing side and a second housing side, at least one first latch receiver on said first housing side, at least one second latch receiver on second housing side, said first latch receiver having a latch catch receiver, said latch catch receiver having means to removably captivate a latch hinge;

at least one second latch receiver on said second housing side, said first and second latch receivers being identical and symmetrical, and wherein there are the same number of latch receivers on each of said first and second housing sides;

said at least one first latch receiver is a cavity formed in said first housing side, said at least one second latch receiver is a cavity formed in said second housing side, said first latch receiver cavity having a pair of spaced side walls and a base extending between spaced side walls, a latch catch receiver having a portion thereof spaced above said base, and said latch catch receiver having a length less than the length of said spaced walls of said first and second housing sides.

20. The light fixture housing on claim 19 wherein said at least one first latch receiver is a cavity formed in said first housing side, said at least one second latch receiver is a cavity formed in said second housing side, said first latch receiver cavity having a pair of spaced side walls and a base extending between said wedged shape side walls, a latch catch receiver having a portion thereof spaced above said base, and said latch catch receiver having a length less than the length of said spaced walls of said first and second housing sides.

21. The light fixture housing of claim 20 wherein said first latch receiver cavity spaced side walls are wedged shaped and extend the width of housing first side, said latch catch receiver having an arcuate surface, and a vertically extending roll pin captivating groove formed in each said wedged shaped side walls.

22. A light fixture housing having an outer surface comprising, a first housing side and a second housing side, at least one first latch receiver cavity formed in said first housing side, at least one second latch receiver cavity formed in said second housing side, said first latch receiver cavity having a pair of wedged shaped spaced side walls extending the width of housing first side and a base extending between said wedged shape side walls, a latch catch receiver inclining from said base and having an arcuate surface to receive a latch catch, said latch catch receiver having a length less than the distance between said spaced walls, a vertically extending roll pin captivating groove formed in each said wedged shaped side walls, said first and second latch receiver cavities being identical and symmetrical, and there are the same number of cavities on each of said 23. A plastic lens for a light fixture having an outer surface comprising a first side and an opposite second side;

at least one first latch holder on the first side of the lens adjacent the periphery of said lens;

said first latch holder having means to retain a latch, wherein said means to retain the latch comprises a pair of spaced substantially parallel latch holder side walls extending upwardly from said lens side and a keeper cavity;

at least one second latch holder on the second side of the lens adjacent the periphery of the lens;

said first and second latch holders being identical and symmetrical; and wherein there are the same number of latch holders on each of said first and second lens sides.

24. The lens of claim 23 wherein said means to retain the latch comprises a pair of spaced substantially parallel latch holder side walls extending upwardly from said lens side and a keeper cavity.

25. The lens of claim 23 wherein the lens has a shoulder periphery, said first lens side and said second lens side converging from an inner portion of said lens shoulder to a lens central portion; said pair of spaced substantially parallel latch holder side walls further extend from an outer portion of the lens shoulder periphery to a portion of the lens side wall width; and said keeper cavity being formed in the shoulder periphery of said lens between said latch holder side walls.

26. The lens of claim 25 wherein the lens is a one-piece plastic molded lens;

said at least first latch holder being integrally formed on the first side of the lens adjacent the periphery of said lens;

a central flat surface inclining from said inner portion of said lens shoulder to said portion of the lens side wall width and a latch holder shoulder joining said latch side walls and said central flat surface, and said at least second latch holder being integrally formed on the second side of the lens adjacent the periphery of the lens.

27. A one-piece plastic molded lens for a light fixture having an outer surface comprising;

a shoulder periphery;

a first side and an opposite second side;

said first and said second sides converging from an inner portion of said lens shoulder to a lens central portion;

at least one first integrally formed latch holder on the first side of the lens adjacent the periphery of said lens;

said first latch holder having a pair of spaced substantially parallel latch holder side walls extending upwardly from said lens first side and extending from an outer portion of the lens shoulder periphery to a portion of the lens side wall width, a keeper cavity formed in the shoulder periphery of said lens between said latch holder side walls;

a central flat surface inclining from said inner portion of said lens shoulder to said portion of the lens side wall width;

a latch holder shoulder joining said latch side walls and said central flat surface;

at least one second integrally formed latch holder on the second side of the lens adjacent the periphery of the lens;

said first and second latch holders being identical and symmetrical; and wherein there are the same number of a latch holders on each of said first and second lens sides.

28. A light fixture lens comprising an outer first lens side, an outer second lens side, at least one latch assembly attached to said first lens side adjacent a periphery of said lens first side, said latch assembly having a latch connector hand section, said hand section having a length greater than a width, said hand section having an inner face and an outer face, a latch section having a first portion extending from said hand section and a catch formed on the end of said first portion, a keeper holder section extending from the inner face of said hand section, a keeper that is securely attachable to said lens first side by insertion into a keeper cavity, and said keeper pivotally attached to said latch keeper holder section of said hand section wherein said at least one latch assembly is attached to said lens, at least one latch/hinge assembly attached to said second lens side adjacent a periphery of said lens second side, said latch/hinge assembly being symmetrical with said latch assembly and there being the same number of latch/hinge assemblies as latch assemblies, and said latch/hinge assembly being substantially the same as said latch assembly with said latch/hinge assembly additionally having means to captivate said latch/hinge assembly in a light fixture housing.

29. The lens of claim 28 wherein said lens has;

at least one first latch holder on the first side of the lens adjacent the periphery of said lens;

said first latch holder having means to retain said latch assembly keeper on said first latch holder;

at least one second latch holder on the second side of the lens adjacent the periphery of the lens;

said first and second latch holders being identical and symmetrical; and wherein there are the same number of latch holders on each of said first and second lens sides.

30. The lens of claim 28 wherein said means to retain the latch assembly comprises a pair of spaced substantially parallel latch holder side walls extending upwardly from said lens side and a keeper cavity, and said latch assembly keeper being retained in said keeper cavity between said latch holder side walls.

31. The lens of claim 28 wherein the lens has a shoulder periphery, said first lens side and said second lens side converging from an inner portion of said lens shoulder to a lens central portion, each of said first and second latch holders having a pair of spaced substantially parallel latch holder side walls extending upwardly from said lens first side and extending from an outer portion of the lens shoulder periphery to a portion of the lens side wall width, keeper cavities formed in the shoulder periphery of said lens between said latch holder side walls, and a latch assembly keeper and a latch/hinge assembly keeper being retained in said keeper cavities.

32. The lens of claim 31 wherein the lens is a one-piece plastic molded lens, said first and second latch holders being integrally formed on the first and second sides of the lens adjacent the periphery of said lens, said first and second latch holders each having a central flat surface inclining from said inner portion of said lens shoulder to said portion of the lens side wall width and a latch holder shoulder joining said latch side walls and said central flat surface.

33. The lens of claim 29 wherein each of said latch and latch/hinge assemblies comprises:

a latch connector having a) a hand section, said hand section having a length greater than a width, said hand section having an inner face and an outer face, b) a latch section, said latch section having a first portion extending from said hand section and a catch formed on the end of said first portion, and c) a keeper holder section extending from the inner face of the said hand section.

34. The lens of claim 33 wherein the inner face of said hand section and the inner face of said latch section form an obtuse angle, said catch having a catch arcuate end, an end of said keeper section providing a keeper holder, a line passing through the arcuate catch end and the keeper holder being substantially parallel with the inner face of said hand section.

35. The lens of claim 33 wherein in each of said latch and latch/hinge assemblies, said keeper has a central keeper portion, a lens attaching portion extending from one end of the central keeper portion and a lens support portion extending from the other end of said central keeper portion, said keeper lens attaching end having means for securing the keeper to said lens retaining means, pivot holder means formed in said keeper central portion, and pivot means to pivotally attach said keeper pivot holder means to said latch keeper holder section.

36. The lens of claim 35 wherein the inner face of said hand section and the inner face of said latch section form an obtuse angle, said catch having a catch arcuate end, an end of said keeper section providing a keeper holder, a line passing through the arcuate catch end and the keeper holder being substantially parallel with the inner face of said hand section.

37. The lens of claim 31 wherein the inner face of said hand section and the inner face of said latch section form an obtuse angle, said catch having a catch arcuate end, an end of said keeper section providing a keeper holder, a line passing through the arcuate catch end and the keeper holder being substantially parallel with the inner face of said hand section, said latch connector is one-piece, pin holding means formed in said catch arcuate end, said keeper being one-piece, said keeper having a width less than the width of said hand section and a length substantially equal to the length of said hand section, said keeper having a central keeper portion, a lens attaching portion extending from one end of the central keeper portion and a lens support portion extending from the other end of said central keeper, said keeper lens attaching end having a plurality of reverse striations on its inner and outer faces, said keeper lens attaching portion inserted in said keeper cavity to secure the keeper to the lens, a third key-hole trough formed in said keeper central portion, and a pair of ball wires extending into said third key-hole and said second hole pivotally attaching said keeper to said latch keeper holder, said ball wires and keeper being sized to provide an over center latch.

38. The lens of claim 29 comprising a roll pin extending from each end of said latch/hinge catch.

39. The lens of claim 33 comprising a roll pin extending from each end of said latch/hinge catch.

40. The lens of claim 37 comprising a roll pin extending from each end of said latch/hinge catch.

* * * * *